US010364826B2

(12) United States Patent
Sishtla

(10) Patent No.: US 10,364,826 B2
(45) Date of Patent: Jul. 30, 2019

(54) INLET GUIDE VANE MECHANISM

(71) Applicant: Carrier Corporation, Farmington, CT (US)

(72) Inventor: Vishnu M. Sishtla, Manlius, NY (US)

(73) Assignee: CARRIER CORPORATION, Farmington, CT (US)

( * ) Notice: Subject to any disclaimer, the term of this patent is extended or adjusted under 35 U.S.C. 154(b) by 415 days.

(21) Appl. No.: 14/768,708

(22) PCT Filed: Feb. 20, 2014

(86) PCT No.: PCT/US2014/017318

§ 371 (c)(1),
(2) Date: Aug. 18, 2015

(87) PCT Pub. No.: WO2014/130628

PCT Pub. Date: Aug. 28, 2014

(65) Prior Publication Data

US 2015/0377250 A1 Dec. 31, 2015

Related U.S. Application Data

(60) Provisional application No. 61/766,755, filed on Feb. 20, 2013.

(51) Int. Cl.
*F04D 29/44* (2006.01)
*F04D 27/02* (2006.01)
(Continued)

(52) U.S. Cl.
CPC ..... *F04D 29/442* (2013.01); *F04D 17/10* (2013.01); *F04D 27/0246* (2013.01);
(Continued)

(58) Field of Classification Search
CPC ..... F04D 29/442; F04D 17/10; F04D 29/444; F04D 25/0606; F04D 27/0261; F04D 29/058; F04D 29/462
See application file for complete search history.

(56) References Cited

U.S. PATENT DOCUMENTS 3,748,068 A * 7/1973 Keller ..... F01C 1/352 418/137
3,996,964 A 12/1976 McCombs
(Continued)

FOREIGN PATENT DOCUMENTS

CN 2536821 Y 2/2003
GB 824270 A 11/1959
(Continued)

OTHER PUBLICATIONS

Notification of Transmittal of the International Search Report and the Written Opinion of the International Searching Authority, or the Declaration for International Application No. PCT/US2014/017318 dated May 21, 2014; 1-13 pages.
(Continued)

*Primary Examiner* — Mark A Laurenzi
*Assistant Examiner* — Shafiq Mian
(74) *Attorney, Agent, or Firm* — Cantor Colburn LLP

(57) ABSTRACT

An inlet guide vane assembly (60) is provided including a plurality of vane subassemblies (62) configured to rotate relative to a blade ring housing (64) to control a volume of air flowing there through. The inlet guide vane assembly (60) also includes a plurality of drive mechanisms (80). Each drive mechanism (80) is operably coupled to one of the plurality of vane subassemblies (62). The vane subassemblies (62) may be rotated independently.

17 Claims, 8 Drawing Sheets

(51) Int. Cl.

| | |
|---|---|
| ***F04D 29/46*** | (2006.01) |
| ***F25B 1/053*** | (2006.01) |
| ***F25B 49/02*** | (2006.01) |
| ***F04D 17/10*** | (2006.01) |
| ***F25B 31/02*** | (2006.01) |

(52) U.S. Cl.
CPC ..... *F04D 29/444* (2013.01); *F04D 29/462* (2013.01); *F25B 1/053* (2013.01); *F25B 31/026* (2013.01); *F25B 49/022* (2013.01); *F05D 2250/51* (2013.01)

(56) References Cited

U.S. PATENT DOCUMENTS

| | | | | |
|---|---|---|---|---|
| 4,151,725 | A | 5/1979 | Kountz | |
| 4,400,135 | A * | 8/1983 | Thebert | F01D 17/162 415/134 |
| 4,546,618 | A | 10/1985 | Kountz et al. | |
| 5,044,879 | A * | 9/1991 | Farrar | F01D 17/162 415/150 |
| 5,281,087 | A * | 1/1994 | Hines | F01D 17/162 415/160 |
| 5,355,691 | A | 10/1994 | Sullivan et al. | |
| 5,669,225 | A | 9/1997 | Beaverson | |
| 6,039,534 | A * | 3/2000 | Stoner | F01D 17/162 415/150 |
| 6,328,526 | B1 * | 12/2001 | Seki | F02C 7/26 415/1 |
| 7,096,657 | B2 | 8/2006 | Mahoney et al. | |
| 8,079,808 | B2 | 12/2011 | Sconfietti | |
| 8,156,757 | B2 | 4/2012 | Doty et al. | |
| 8,276,362 | B2 | 10/2012 | Suciu et al. | |
| 8,348,600 | B2 | 1/2013 | Norris et al. | |
| 2007/0154302 | A1 * | 7/2007 | Sconfietti | F04D 29/462 415/191 |
| 2008/0115527 | A1 * | 5/2008 | Doty | F04D 25/0606 62/498 |
| 2009/0229280 | A1 * | 9/2009 | Doty | F04D 29/284 62/115 |
| 2009/0232643 | A1 | 9/2009 | Norris et al. | |
| 2009/0297334 | A1 | 12/2009 | Norris et al. | |
| 2010/0172745 | A1 * | 7/2010 | Hodder | F04D 29/462 415/163 |
| 2010/0296913 | A1 | 11/2010 | Lee | |
| 2010/0329898 | A1 * | 12/2010 | Dunn | F04B 49/22 417/300 |
| 2011/0110765 | A1 | 5/2011 | Duong et al. | |
| 2011/0194904 | A1 * | 8/2011 | Carlson | F04B 49/22 406/12 |
| 2012/0121403 | A1 * | 5/2012 | Clemons | F01D 17/162 415/208.1 |
| 2015/0275908 | A1 * | 10/2015 | Sishtla | F04D 29/462 415/1 |
| 2015/0322965 | A1 * | 11/2015 | Hasegawa | F04D 25/02 415/150 |

FOREIGN PATENT DOCUMENTS

| | | | |
|---|---|---|---|
| GB | 2410530 | A | 8/2005 |
| KR | 20100100240 | A | 6/2017 |
| WO | 2006059999 | A1 | 6/2006 |

OTHER PUBLICATIONS

Chinese Office Action and Search Report for CN 201480009428.0, dated Oct. 9, 2016, 7pgs.

PCT International Preliminary Report on Patentability; International Application No. PCT/US2014/017318; International Filing Date: Feb. 20, 2014; dated Aug. 25, 2015, pp. 1-8.

Second CN Office Action with Translation; CN Application No. 201480009428.0; dated Jun. 6, 2017; pp. 1-19.

* cited by examiner

INLET GUIDE VANE MECHANISM

CROSS-REFERENCE TO RELATED APPLICATIONS

This application claims the benefit of U.S. provisional patent application Ser. No. 61/766,755 filed Feb. 20, 2013, the entire contents of which are incorporated herein by reference.

BACKGROUND OF THE INVENTION

The invention relates generally to chiller refrigeration systems and, more particularly, to a method of individually controlling inlet guide vanes at an inlet of a compressor of the chiller refrigeration system.

In many conventional chillers, the compressor, such as a centrifugal compressor for example, is driven by a driving means, such as an electric motor for example, either directly or through a transmission. Optimum performance of the compressor is strongly influenced by the rotating speed of the compressor. The volume of refrigerant flowing through the compressor must be adjusted for changes in the load demanded by the air conditioning requirements of the space being cooled. Control of the flow is typically accomplished by varying the inlet guide vanes and the impeller speed, either separately or in a coordinated manner.

When a conventional chiller system is initially started, the inlet guide vanes assembly is typically arranged in a fully closed position, allowing only a minimum amount of flow into the compressor to prevent the motor from stalling. Once the motor is operating at a maximum speed, the inlet guide vanes are rotated together to a generally open position based on the flow entering into the compressor. Conventional inlet guide vane assemblies includes a set of vanes, such as 7 or 11 vanes for example, connected by a cable to a group of idler and drive pulleys. The drive pulleys of the assembly are actuated by a motor coupled to the drive pulleys through a drive chain. The complex mechanical system for adjusting the position of the inlet guide vanes is labor intensive to manufacture and prone to assembly errors. In addition, because of the complex connection between an actuator and the vanes, the inlet guide vane assembly is slow to respond to an adjustment thereof.

BRIEF DESCRIPTION OF THE INVENTION

According to an aspect of the invention, an inlet guide vane assembly is provided including a plurality of vane subassemblies configured to rotate relative to a blade ring housing to control a volume of air flowing there through. The inlet guide vane assembly also includes a plurality of drive mechanisms. Each drive mechanism is operably coupled to one of the plurality of vane subassemblies. The vane subassemblies in the inlet guide vane assembly may be rotated independently.

According to another embodiment of the invention, a compressor assembly for a chiller refrigeration system is provided including a compressor. An inlet guide vane assembly is arranged generally within a suction housing positioned adjacent an inlet of the compressor. The inlet guide vane assembly includes a plurality of vane subassemblies configured to rotate relative to the suction housing to control a volume of air flowing into the compressor. The inlet guide vane assembly also includes a plurality of drive mechanisms. Each drive mechanism is operably coupled to one of the plurality of vane subassemblies. The vane subassemblies may be rotated independently.

According to yet another embodiment of the invention, a method of positioning an inlet guide vane assembly of a compressor in a chiller refrigeration system is provided including determining a position of each vane subassembly. The position is determined by a controller based on a current position of each vane subassembly in the inlet guide vane assembly and also based on load conditions of the chiller refrigeration system. Power is provided to at least one of the plurality of drive mechanisms, each of which is coupled to a vane subassembly. The at least one vane subassembly is moved independently to the determined position.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
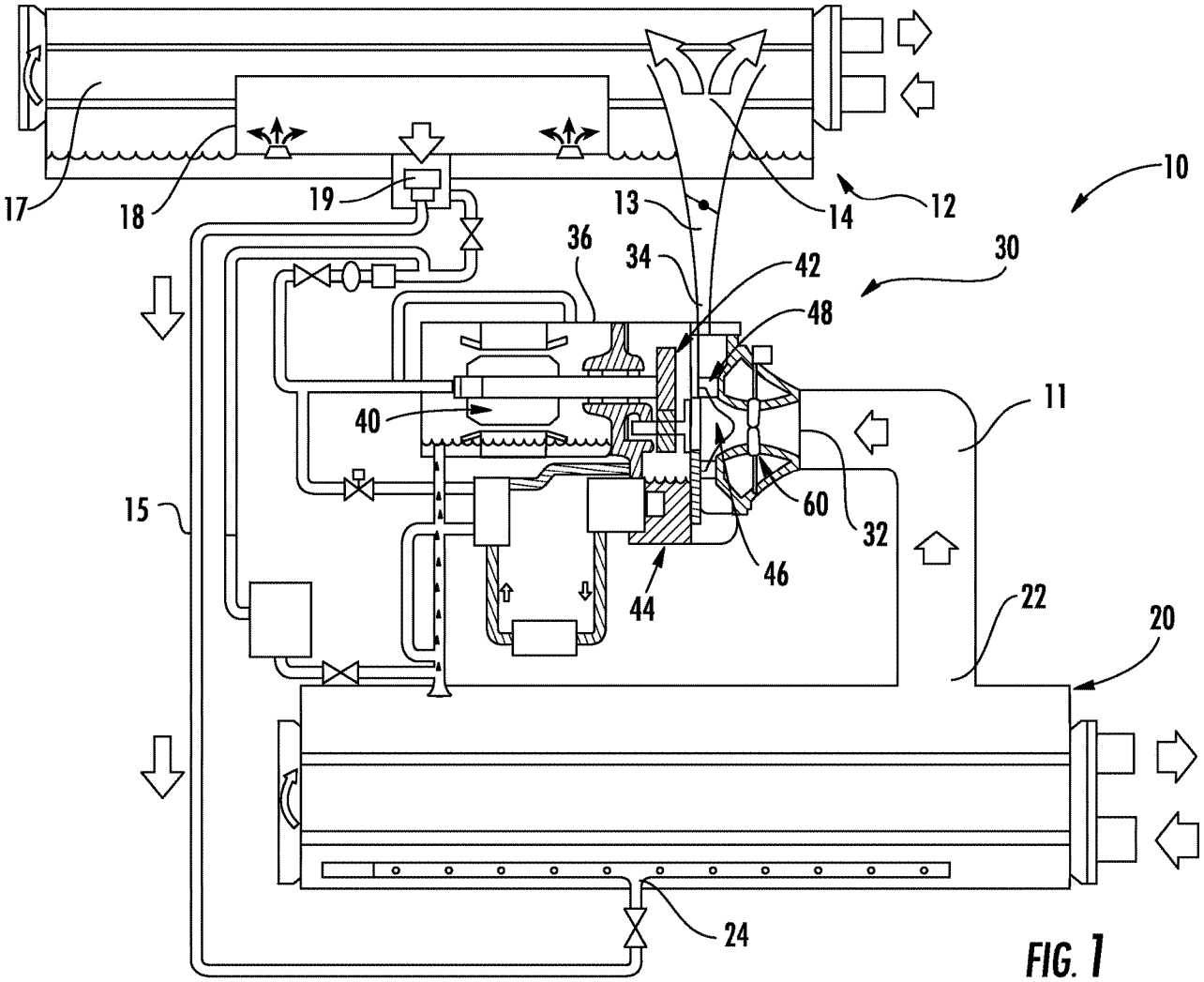
FIG. 1 is a schematic illustration of an exemplary chiller refrigeration system.
Figure 2:
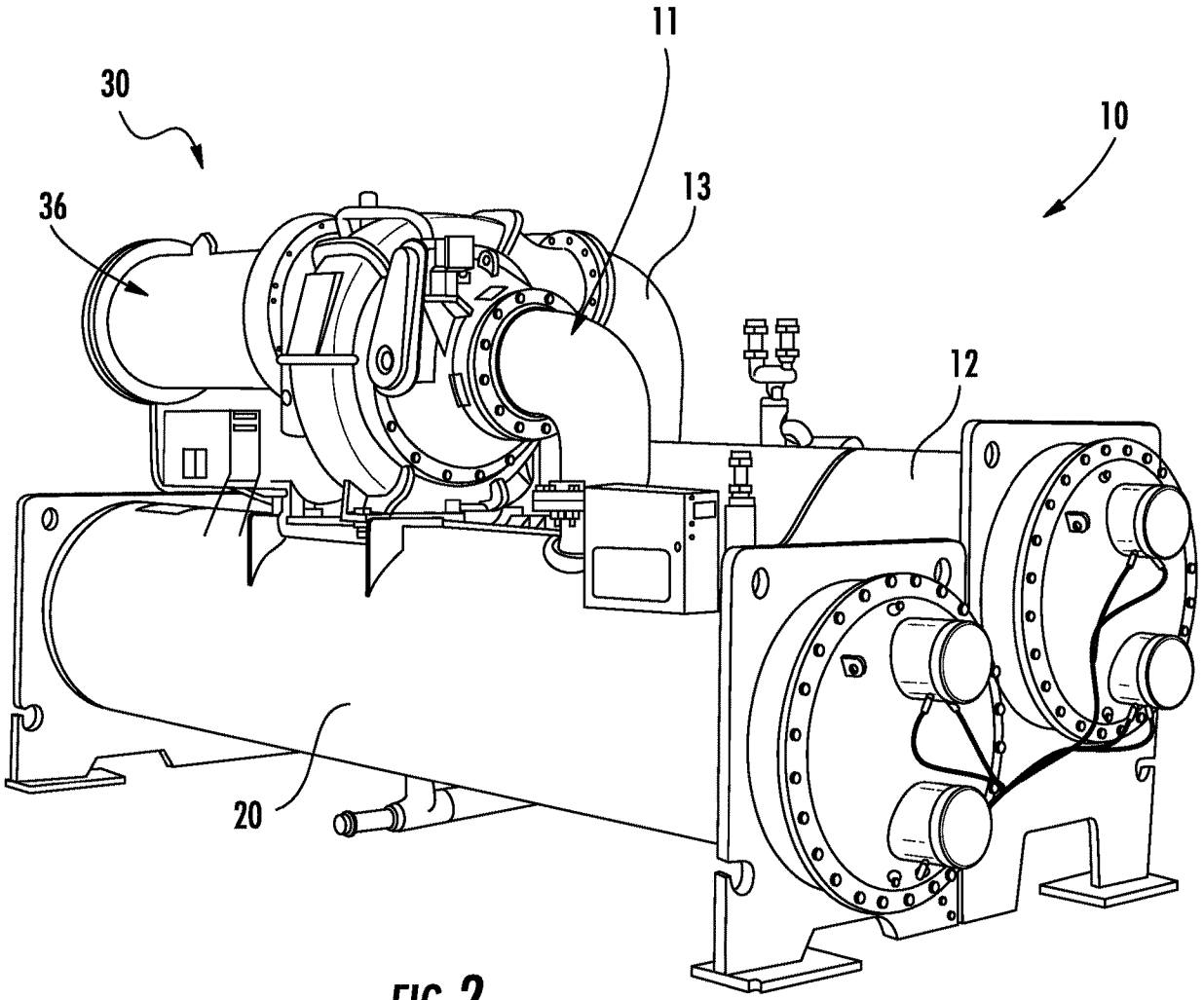
FIG. 2 is a perspective view of an exemplary chiller refrigeration system.
Figure 3:
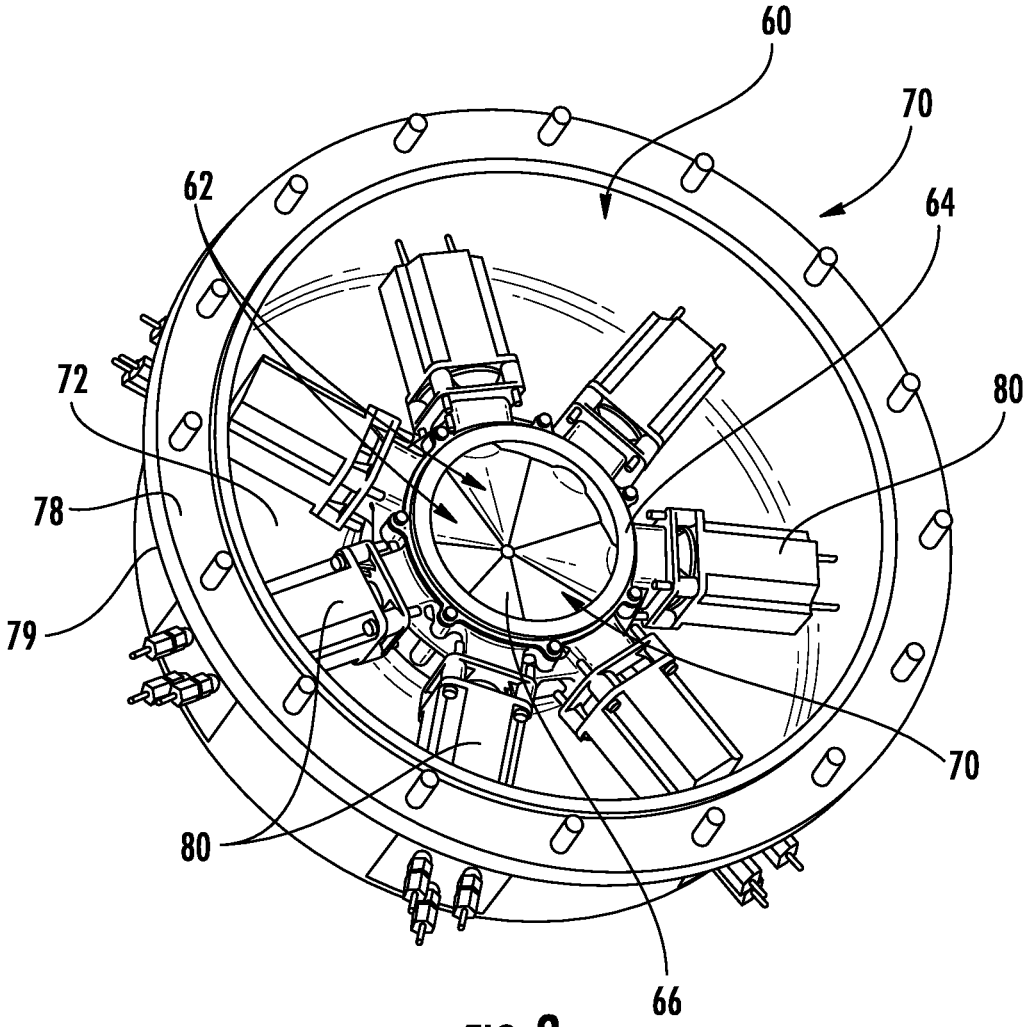
FIG. 3 is a perspective view of an inlet guide vane assembly according to an embodiment of the invention.
Figure 4:
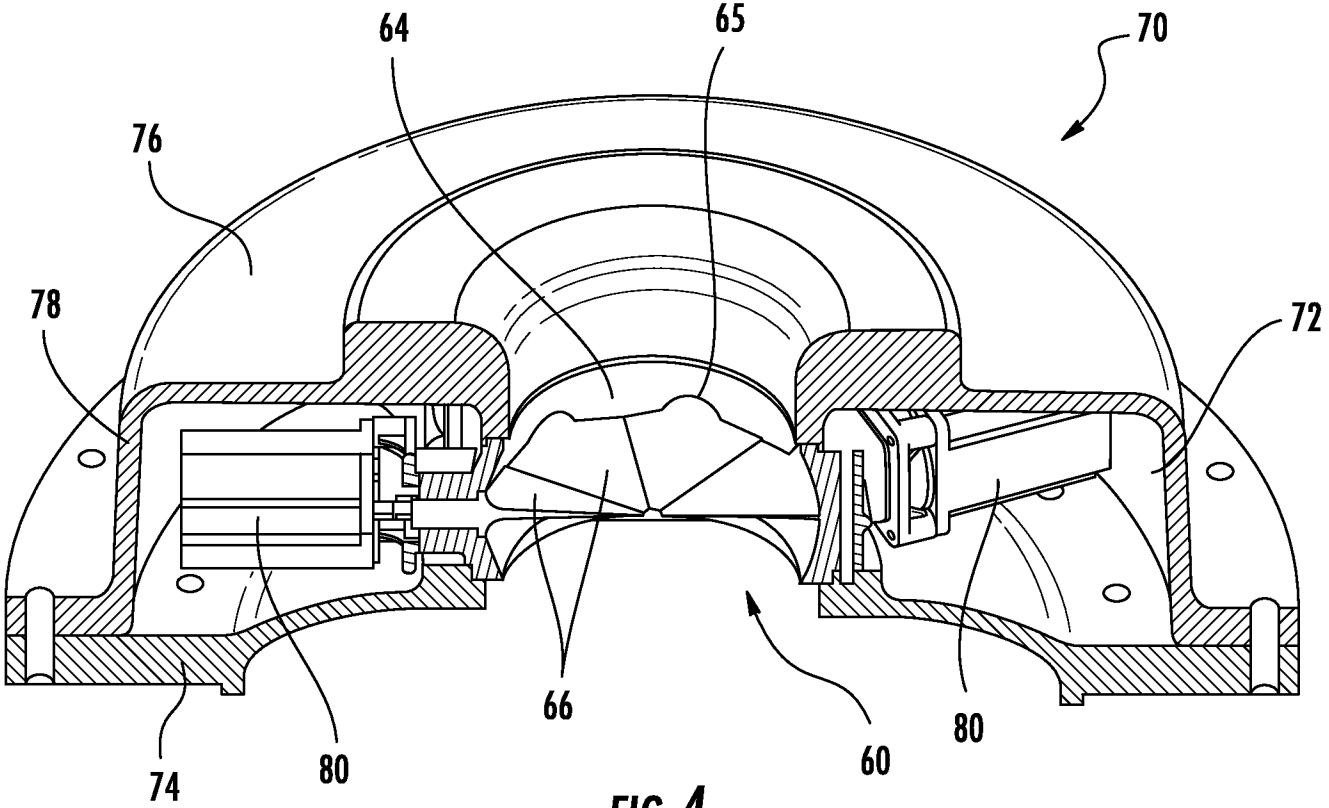
FIG. 4 is a perspective, cross-sectional view of an inlet guide vane assembly according to an embodiment of the invention.
Figure 5:
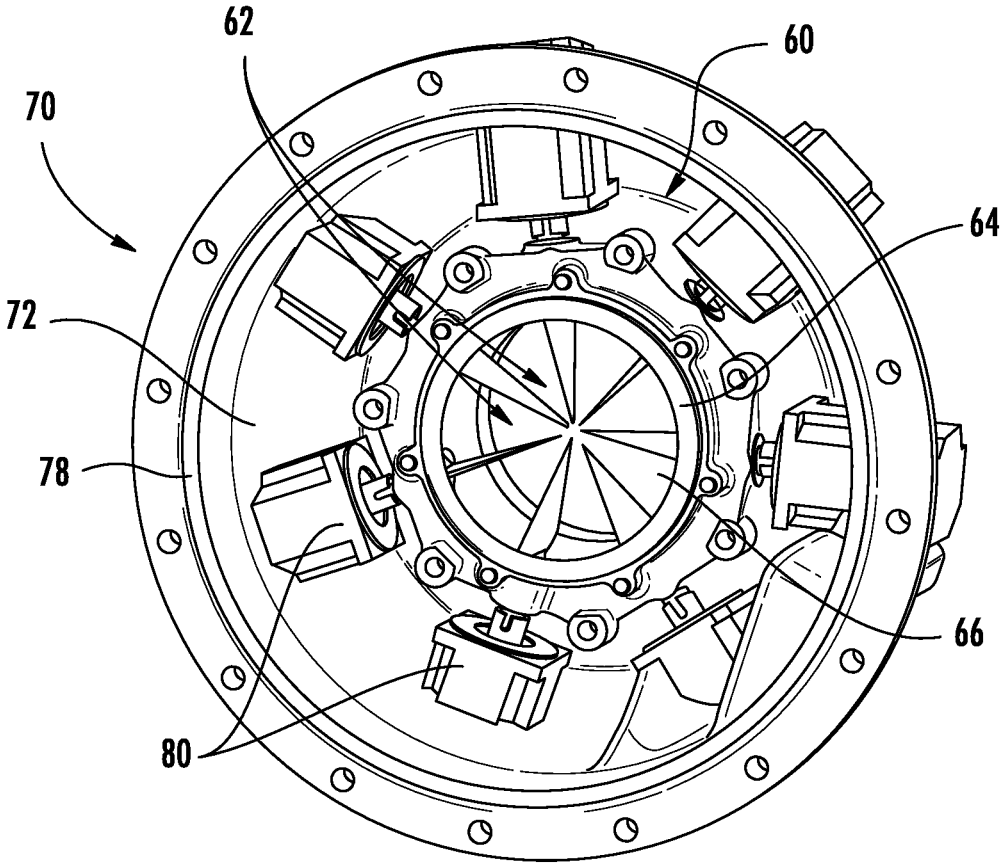
FIG. 5 is perspective view of an inlet guide vane assembly according to an embodiment of the invention.
Figure 6:
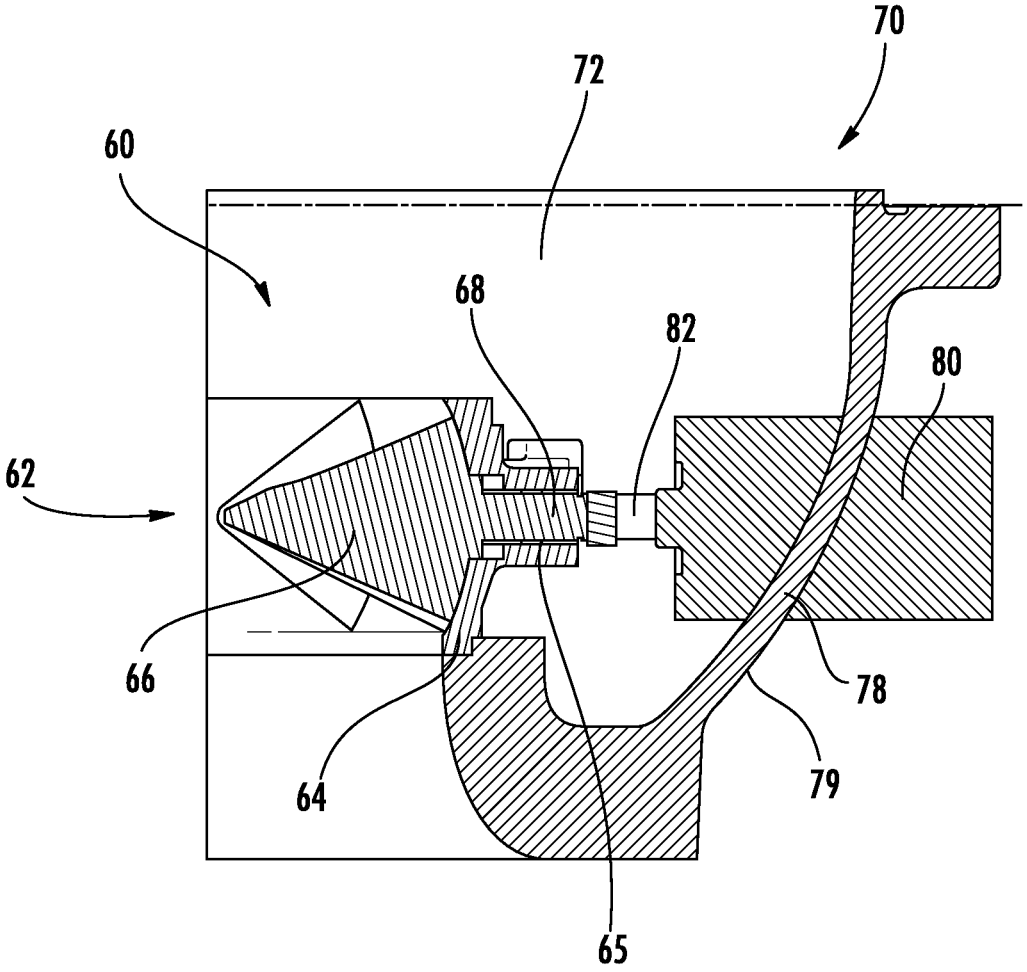
FIG. 6 is a cross-sectional view of a portion of an inlet guide vane assembly according to an embodiment of the invention.
Figure 7:
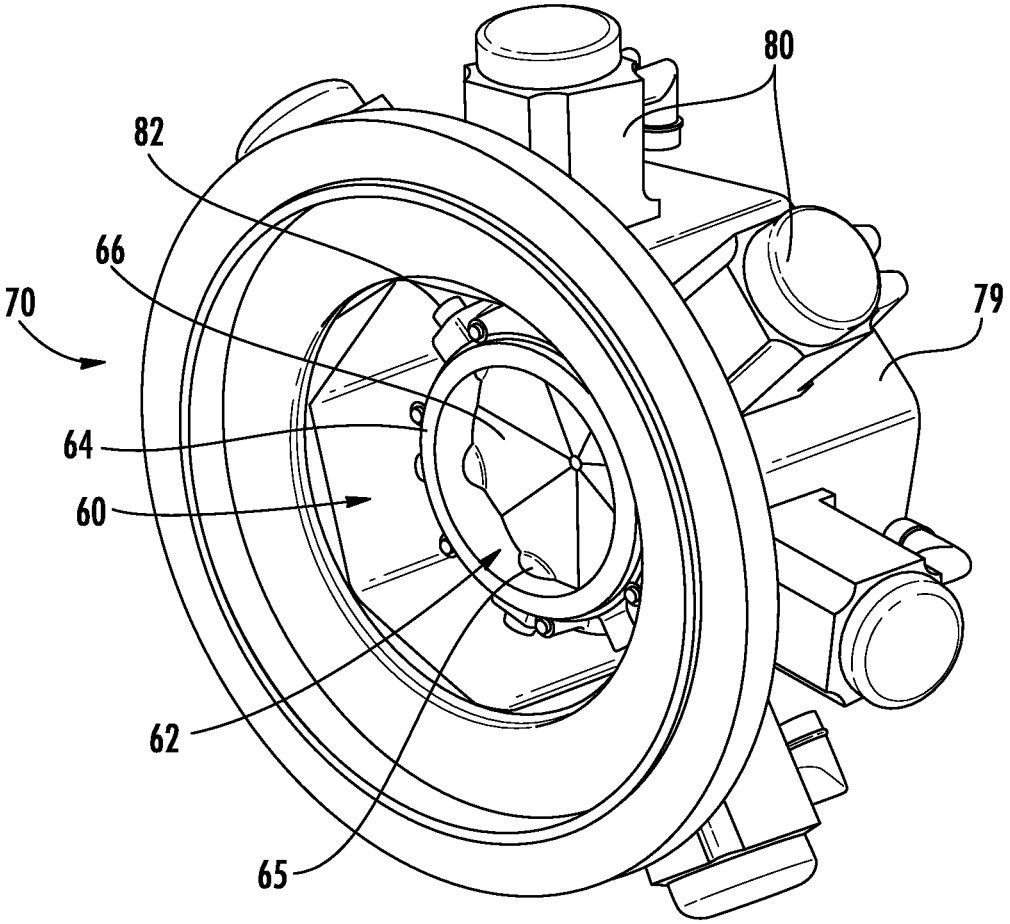
FIG. 7 is a perspective view of an inlet guide vane assembly according to an embodiment of the invention.

Referring now to FIGS. 1 and 2, the illustrated exemplary chiller refrigeration system 10 includes a compressor assembly 30, a condenser 12, and a cooler or evaporator 20 fluidly coupled to form a circuit. A first conduit 11 extends from adjacent the outlet 22 of the cooler 20 to the inlet 32 of the compressor assembly 30. The outlet 34 of the compressor assembly 30 is coupled by a conduit 13 to an inlet 14 of the condenser 12. In one embodiment, the condenser 12 includes a first chamber 17, and a second chamber 18 accessible only from the interior of the first chamber 17. A float valve 19 within the second chamber 18 is connected to an inlet 24 of the cooler 20 by another conduit 15. Depending on the size of the chiller system 10, the compressor assembly 30 may include a rotary, screw, or reciprocating compressor for small systems, or a screw compressor or centrifugal compressor for larger systems. A typical compressor assembly 30 includes a housing 36 having a motor 40 at one end and a centrifugal compressor 44 at a second, opposite end, with the two being connected by a transmission assembly 42. The compressor 44 includes an impeller 46 for accelerating the refrigerant vapor to a high velocity, a diffuser 48 for decelerating the refrigerant to a low velocity while converting kinetic energy to pressure energy, and a discharge plenum (not shown) in the form of a volute or collector to collect the discharge vapor for subsequent flow to a condenser. Positioned near the inlet 32 of the compressor 30 is an inlet guide vane assembly 60. Because a fluid flowing from the cooler 20 to the compressor 44 must first pass through the inlet guide vane assembly 60 before entering the impeller 46, the inlet guide vane assembly 60 may be used to control the fluid flow into the compressor 44.

The refrigeration cycle within the chiller refrigeration system 10 may be described as follows. The compressor 44 receives a refrigerant vapor from the evaporator/cooler 20 and compresses it to a higher temperature and pressure, with the relatively hot vapor then passing into the first chamber 17 of the condenser 12 where it is cooled and condensed to a liquid state by a heat exchange relationship with a cooling medium, such as water or air for example. Because the second chamber 18 has a lower pressure than the first chamber 17, a portion of the liquid refrigerant flashes to vapor, thereby cooling the remaining liquid. The refrigerant vapor within the second chamber 18 is re-condensed by the cool heat exchange medium. The refrigerant liquid then drains into the second chamber 18 located between the first chamber 17 and the cooler 20. The float valve 19 forms a seal to prevent vapor from the second chamber 18 from entering the cooler 20. As the liquid refrigerant passes through the float valve 19, the refrigerant is expanded to a low temperature two phase liquid/vapor state as it passed into the cooler 20. The cooler 20 is a heat exchanger which allows heat energy to migrate from a heat exchange medium, such as water for example, to the refrigerant gas. When the gas returns to the compressor 44, the refrigerant is at both the temperature and the pressure at which the refrigeration cycle began.

Referring now to FIGS. 3-7, the inlet 32 of the compressor assembly 30 includes a suction housing 70 having a cavity 72 within which the inlet guide vane assembly 60 is positioned. The inlet guide vane assembly 60 includes a plurality of vane subassemblies 62 rotatably coupled to a blade ring housing 64. Each vane subassembly 62 includes a generally flat air foil vane 66 connected to a vane shaft 68. The blade ring housing 64 includes a plurality of generally equidistantly spaced openings 65 configured to receive the vane shafts 68. In one embodiment, the plurality of vane shafts 68 are received within bearings (not shown) mounted within the openings 65 of the blade ring housing 64.

The inlet guide vane assembly 60 additionally includes a plurality of drive mechanisms 80 configured to rotate the vane subassemblies 62 relative to the blade ring housing 64. Exemplary drive mechanisms 80 include, but are not limited to, actuators, stepper motors, and servo motors for example. The plurality of drive mechanisms 80 substantially equals the plurality of vane subassemblies 62 such that each vane subassembly 62 is operably coupled to an individual drive mechanism 80. As a result, the plurality of vane subassemblies 62 may be operated independently. In one embodiment, a portion of each drive mechanism 80, for example a shaft 82, is directly coupled to the vane shaft 66 of a corresponding vane subassembly 62, such as with a coupling for example. The drive mechanisms 80 may be arranged at any of a number of locations relative to the suction housing 70. In one embodiment, illustrated in FIGS. 3 and 4, the drive mechanisms 80 may be arranged within the cavity 72 of the suction housing 70, adjacent the blade ring housing 64. In such embodiments, the suction housing 70 may be formed as a single piece or alternatively may be formed as a cover 74 and a back plate 76 that couple to form a cavity 72 there between. In another embodiment, shown in FIGS. 5 and 6, the drive mechanisms 80 may extend through the wall 78 of the suction housing 70 such that only the portion of the drive mechanism 80 configured to couple to a vane subassembly 62 is arranged within the cavity 72. In yet another embodiment, the drive mechanisms 80 may be mounted to an exterior surface 79 of the suction housing 70 such that only the shaft 82 of the drive mechanisms 80 extends through the wall 78 of the suction housing 70.

Figure 8:
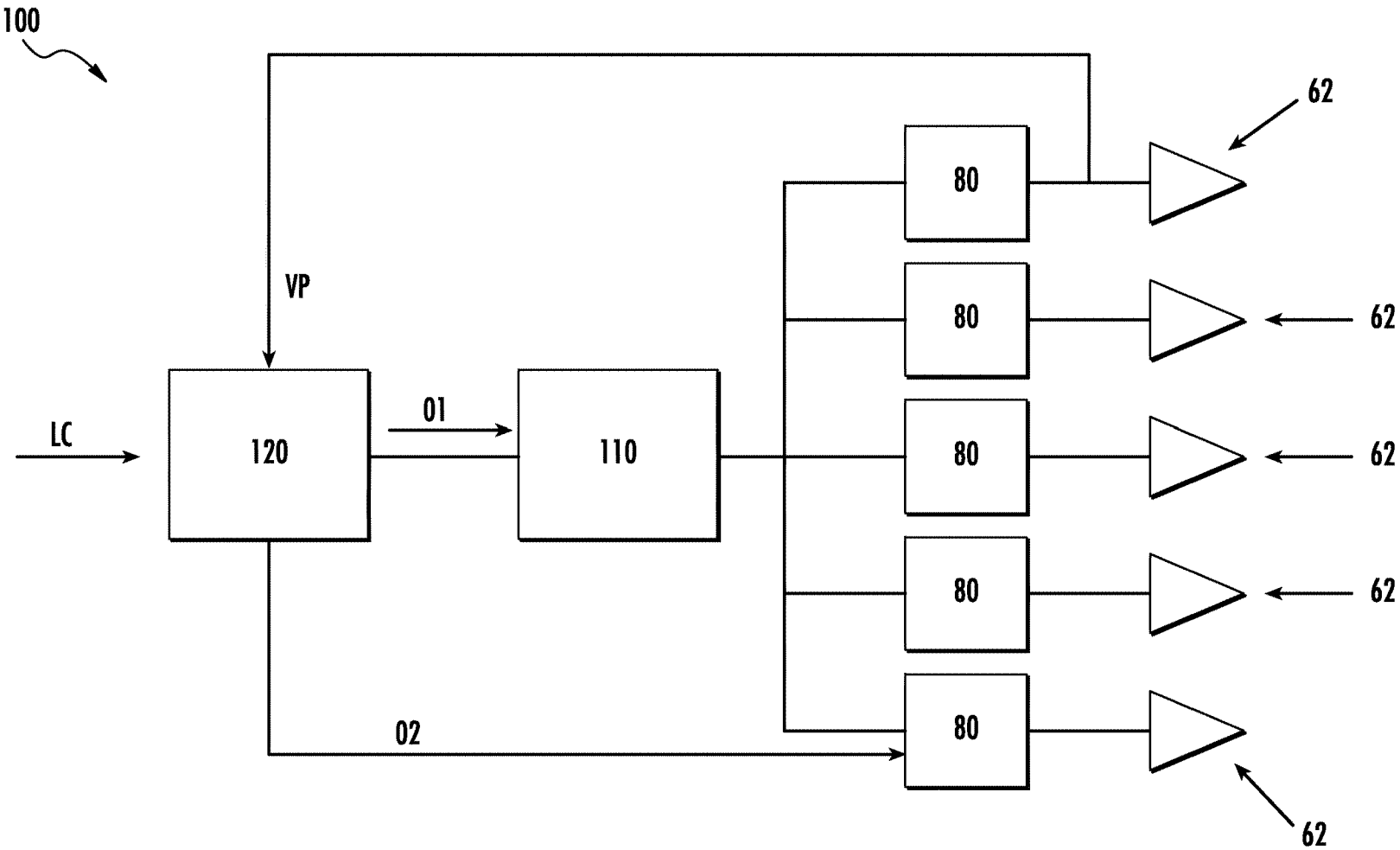
FIG. 8 is a control system of the inlet guide vane assembly according to an embodiment of the invention.

Referring now to FIG. 8, a control system 110 of the chiller refrigeration system 10 includes a power source 110 connected to each of the plurality of drive mechanisms 80 and a controller 120 operably coupled to the power source 110. The controller 120 is configured to control the cooling capacity of the chiller 10 in response to load conditions, such as by adjusting the positioning of the inlet guide vane assembly 60 for example. Each of the vane subassemblies 62, or the drive mechanisms 80 coupled thereto, may include a sensor (not shown), such as a position sensor or encoder for example. These sensors are configured to provide an input signal, illustrated schematically as VP, to the controller 120 indicative of the current position of a corresponding vane subassembly 62. In response to the input signals indicative of the load conditions of the chiller 10, illustrated schematically as LC, and the position signals VP from the sensors of the inlet guide vane assembly 60, the controller 120 will determine an allowable position for each of the plurality of vane subassemblies 62. In response to a first output signal O1 from the controller 120, the power source 110 supplies power to one or more of the drive mechanisms 80. The controller 120 may also provide a second output signal O2 to the one or more drive mechanisms 80 being powered by the power source 110. The second output signal O2 indicates to the powered drive mechanisms 80 which direction to rotate the coupled vane subassemblies 62 and what amount to rotate the coupled vane subassemblies 62 in that direction. The position signals VP of the vane subassemblies 62 may be provided to the controller 120 to verify that the appropriate vanes 66 of the inlet guide vane assembly 60 were rotated to the commanded position. In one embodiment, when the compressor assembly 30 is powered on or powered off, the controller 120 may command that the plurality of vane subassemblies 62 return to a default position, such as a fully closed position for example. In addition, in the event of a failure of one of the drive mechanisms 80 coupled to a first vane subassembly 62, the controller 120 may be configured to similarly freeze the position of the vane subassembly 62 substantially opposite the first vane subassembly to create a generally symmetric flow into the impeller 46.

By coupling a drive mechanism 80 to each vane subassembly 62, each of the plurality of vane subassemblies 62 may be independently controlled. Because the flow entering into inlet 32 of the compressor assembly 30 is generally non-uniform, independent operation the vane subassemblies allows for more efficient operation of the chiller refrigeration system 10. In addition, use of the plurality of drive mechanisms 80 reduces the complexity of the inlet guide vane assembly by eliminating a significant number of moving parts. This simplification of the inlet guide vane assembly 60 may also result in a reduced cost.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An inlet guide vane assembly, comprising:

a plurality of vane subassemblies configured to rotate relative to a blade ring housing to control a volume of air flowing there through; and a plurality of independently operable drive mechanisms, each of the plurality of drive mechanisms being operably coupled to one of the plurality of vane subassemblies such that each of the vane subassemblies is rotatable about a respective axis independently.

2. The inlet guide vane assembly according to claim 1, wherein the drive mechanisms are selected from one of an actuator, stepper motor, and servo motor.

3. The inlet guide vane assembly according to claim 1, wherein each vane subassembly includes a flat air foil vane connected to a vane shaft.

4. The inlet guide vane assembly according to claim 3, wherein a coupling directly couples each vane shaft to a shaft of one of the plurality of drive mechanisms.

5. The inlet guide vane assembly according to claim 1, wherein the plurality of drive mechanisms are arranged adjacent the blade ring housing within a cavity of a suction housing.

6. The inlet guide vane assembly according to claim 5, wherein the suction housing includes a cover connected to a back plate to form the cavity.

7. The inlet guide vane assembly according to claim 1, wherein the inlet guide vane assembly is arranged within a cavity of a suction housing and the plurality of drive mechanisms is located adjacent an exterior surface of the suction housing.

8. The inlet guide vane assembly according to claim 1, wherein the inlet guide vane assembly is arranged within a cavity of a suction housing and a portion of each of the plurality of drive mechanisms extends through a wall of the suction housing into the cavity.

9. A compressor assembly of a chiller refrigeration system, comprising:

a compressor; and an inlet guide vane assembly arranged generally within a suction housing positioned adjacent an inlet of the compressor, the inlet guide vane assembly including a plurality of vane subassemblies configured to rotate relative to the suction housing to control a volume of air flowing into the compressor, and a plurality of independently operable drive mechanisms, each of the plurality of drive mechanisms being operably coupled to one of the plurality of vane subassemblies such that each of the vane subassemblies is rotatable about a respective axis independently.

10. The compressor assembly according to claim 9, wherein the drive mechanisms are selected from one of an actuator, stepper motor, and servo motor.

11. The compressor assembly according to claim 10, wherein each vane subassembly includes a flat air foil vane connected to a vane shaft.

12. The compressor assembly according to claim 11, wherein a coupling directly couples each vane shaft to a shaft of one of the plurality of drive mechanisms.

13. The inlet guide vane assembly according to claim 9, wherein the plurality of drive mechanisms are arranged adjacent the blade ring housing within a cavity of a suction housing.

14. The inlet guide vane assembly according to claim 13, wherein the suction housing includes a cover connected to a back plate to form the cavity.

15. A method of positioning an inlet guide vane assembly of a compressor in a chiller refrigeration system, the method comprising:

determining, using a controller, an allowable position of each vane subassembly of a plurality of vane subassemblies in response to a current position of each vane subassembly in the inlet guide vane assembly and load conditions of the chiller refrigeration system;

providing power from a power source to at least one of a plurality of drive mechanisms, each drive mechanism being coupled to a single vane subassembly, wherein a first output signal provided to the power source by the controller indicates to which of the plurality of drive mechanisms the power source should supply power; and moving the at least one vane subassembly independently from another vane subassembly to the predetermined position.

16. The method according to claim 15, wherein a second output signal provided by the controller indicates a direction and an amount that each of the vane subassemblies should be rotated.

17. The method according to claim 15, wherein a position signal provided to the controller by each of the plurality of vane subassemblies is used to verify that each of the vane subassemblies was moved to the determined position.

* * * * *